United States Patent [19]

Cocchi

[11] Patent Number: 4,771,710

[45] Date of Patent: Sep. 20, 1988

[54] ELEMENT OF STEPWISE GRID FOR WASTES INCINERATOR FURNACES WITH IMPROVED AIR CIRCULATION AND AIR-TIGHTNESS

[75] Inventor: Giuliano Cocchi, Milan, Italy

[73] Assignee: S.p.A. Forni ed Impianti Industriali Ingg. De Bartolomeis, Milan, Italy

[21] Appl. No.: 21,218

[22] Filed: Mar. 3, 1987

[30] Foreign Application Priority Data

Sep. 8, 1986 [IT] Italy ..... 22951/86[U]

[51] Int. Cl.[4] ..... F23K 7/04

[52] U.S. Cl. ..... 110/281; 110/285; 110/291; 126/174

[58] Field of Search ..... 110/281, 289, 290–298, 110/328, 283; 126/174, 152 R, 175; 34/164; 198/773–775, 750

[56] References Cited

U.S. PATENT DOCUMENTS 4,018,168 4/1977 Andreoli et al. ..... 110/281
4,463,688 8/1984 Andreoli ..... 110/281
4,676,176 6/1987 Bonomelli ..... 110/281

FOREIGN PATENT DOCUMENTS 456005 10/1928 Fed. Rep. of Germany ..... 110/281
3343024 7/1985 Fed. Rep. of Germany ... 110/163 R

*Primary Examiner*—James C. Yeung
*Attorney, Agent, or Firm*—Foley, Lardner, Schwartz, Jeffery, Schwaab, Mack, Blumenthal & Evans

[57] ABSTRACT

Element of stepwise grid for waste incinerator furnaces of the type forming, together with other similar grid elements, a course or step of a grid borne on a support beam comprising a rear articulated joint and a front thrust portion, provided with a swinging and sweeping hammer which slides on a grid element of a lower step, characterized in that it comprises an upper plate and a lower support box, coupled to each other by means of pairs of rear portions bent to a hook shape, which hook themselves onto said articulated joint, said articulated joint being accomplished by a continuous bar stably constrained to support plates welded onto said support beam.

6 Claims, 4 Drawing Sheets

ELEMENT OF STEPWISE GRID FOR WASTES INCINERATOR FURNACES WITH IMPROVED AIR CIRCULATION AND AIR-TIGHTNESS

BACKGROUND OF THE INVENTION

1. Field of the Invention

The present invention relates to an element of a stepwise grid for waste incinerator furnaces endowed with improved air circulation and air-tightness characteristics, in particular for solid urban waste incineration.

2. Related Art

The incinerator furnaces for solid urban waste use stepwise grids on which the drying and the combustion of the waste occurs, also at high temperatures. The above-said steps must consequently allow such thermal expansion to allow the furnace to properly operate, and furthermore prevent that, during the alternative motion between stationary steps and moving steps, any waste being treated from accidentally penetrating between two adjacent steps.

For that purpose, the prior art provides side joint coverings, protruding from one side of the grid elements, and which can be coupled relative to the other smooth side of the adjacent grid elements, so as to secure the tightness against the infiltration of waste between adjacent steps.

It is furthermore known that such joint coverings should cooperate to accomplish the tightness necessary to prevent leaks of combustion air, so as to allow, together with the hollows provided in the grid, elements, a good blowing in of air.

So far, all of the above is at least partly accomplished, with an approximate tightness and a disordered air circulation, which are not always are able to guarantee perfect operation of the steps, the adequate cooling thereof, and an optimum tightness thereof to the waste.

The grid elements used to date are mounted by means of rear pivots, constrained through latch devices which do not allow them to be easily positioned or replaced.

SUMMARY OF THE INVENTION

A purpose of the present invention is to provide a stepwise grid element of incinerator furnaces, wherein the above said problems are completely solved, thus allowing an optimum operation, while at the same time considerably simplifying their construction, improving their strength, and rendering easier the positioning thereof.

These and other purposes according to the present invention are achieved by providing an element of a stepwise grid for waste incinerator furnaces of the type forming, together with other similar grid elements, a course or step of a grid borne on a support beam comprising a rear articulated joint and a front thrust portion, provided with a swinging and sweeeping hammer which slides on a grid element of a lower step, characterized in that it comprises an upper plate and a lower support box, coupled to each other by means of pairs of rear portions bent to a hook shape, which hook themselves onto said articulated joint, said articulated joint being accomplished by a continuous bar stably constrained to support plates welded onto said support beam.

BRIEF DESCRIPTION OF THE DRAWINGS

The structural and functional characteristics and the advantages of an element of stepwise grid according to the present invention shall be better understood from the following exemplifying and not limitative disclosure, relating to the hereto attached schematic drawings, wherein.

DETAILED DESCRIPTION OF THE PREFERRED EMBODIMENTS

Figure 1:
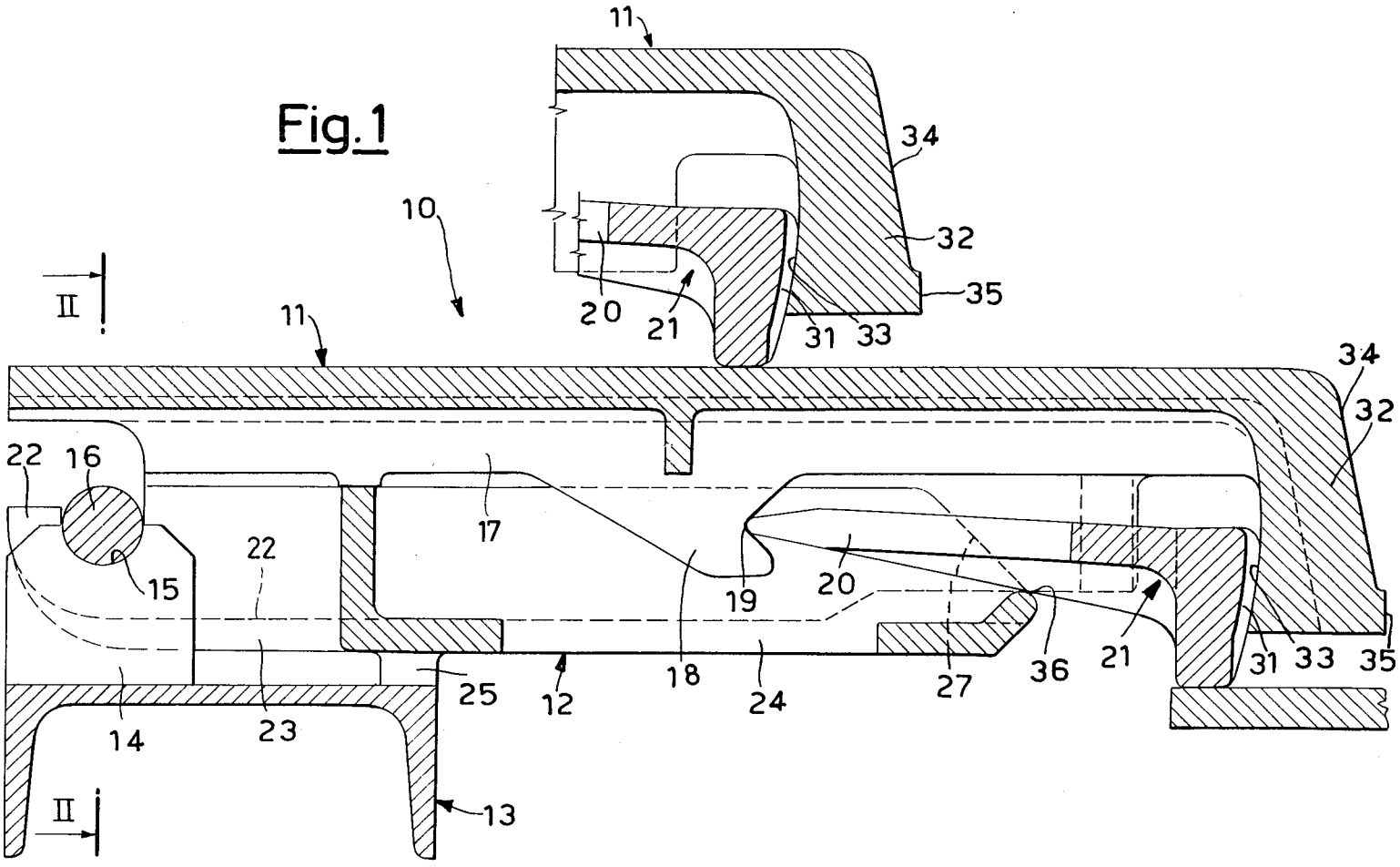
FIG. 1 is a transverse sectional view of a grid element according to the present invention, according to path I—I of FIG. 2.
Figure 2:
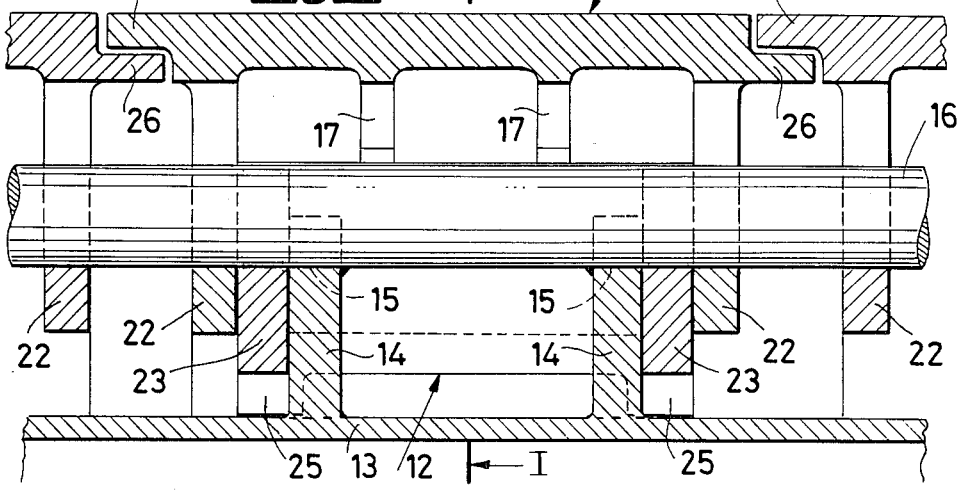
FIG. 2 is a sectional view according to path II—II of FIG. 1.
Figure 5:
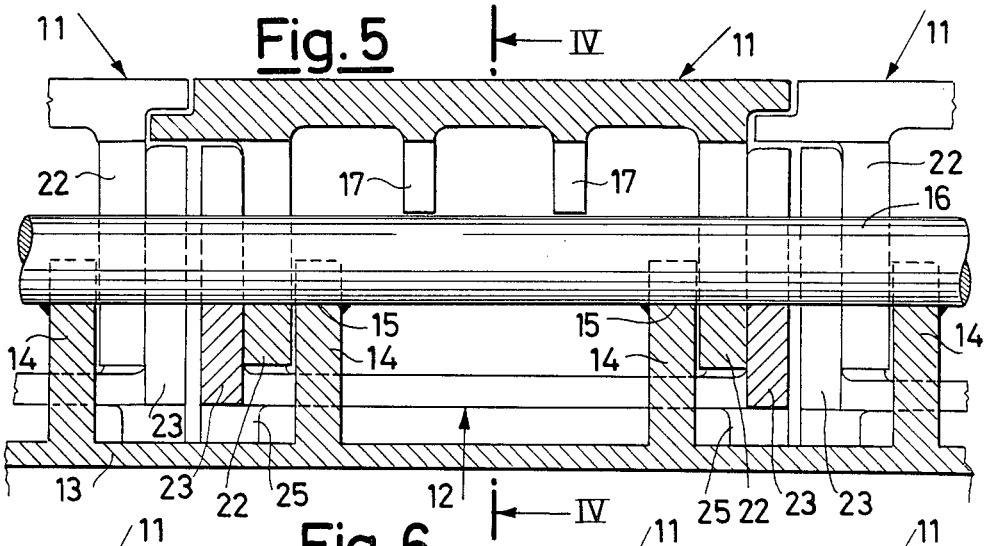
FIG. 5 is a sectional view according to path V—V of FIG. 4.
Figure 6:
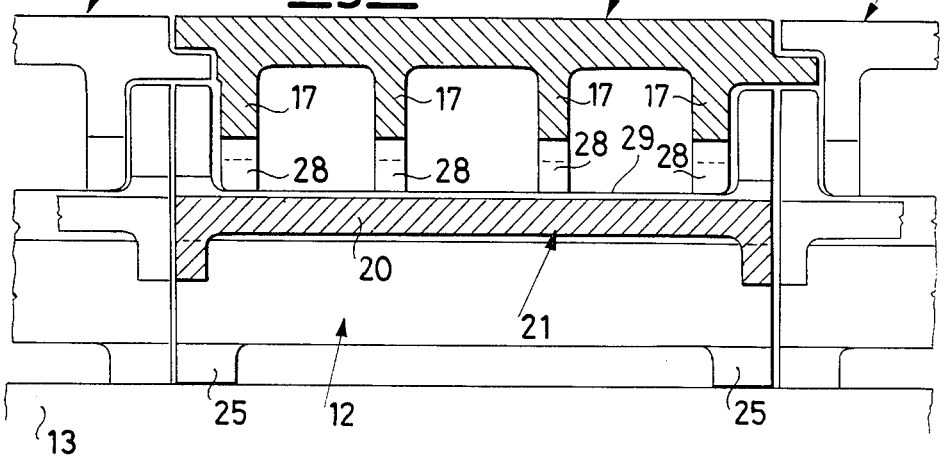
FIG. 6 is a sectional view according to path VI—VI of FIG. 4.
Figure 3:
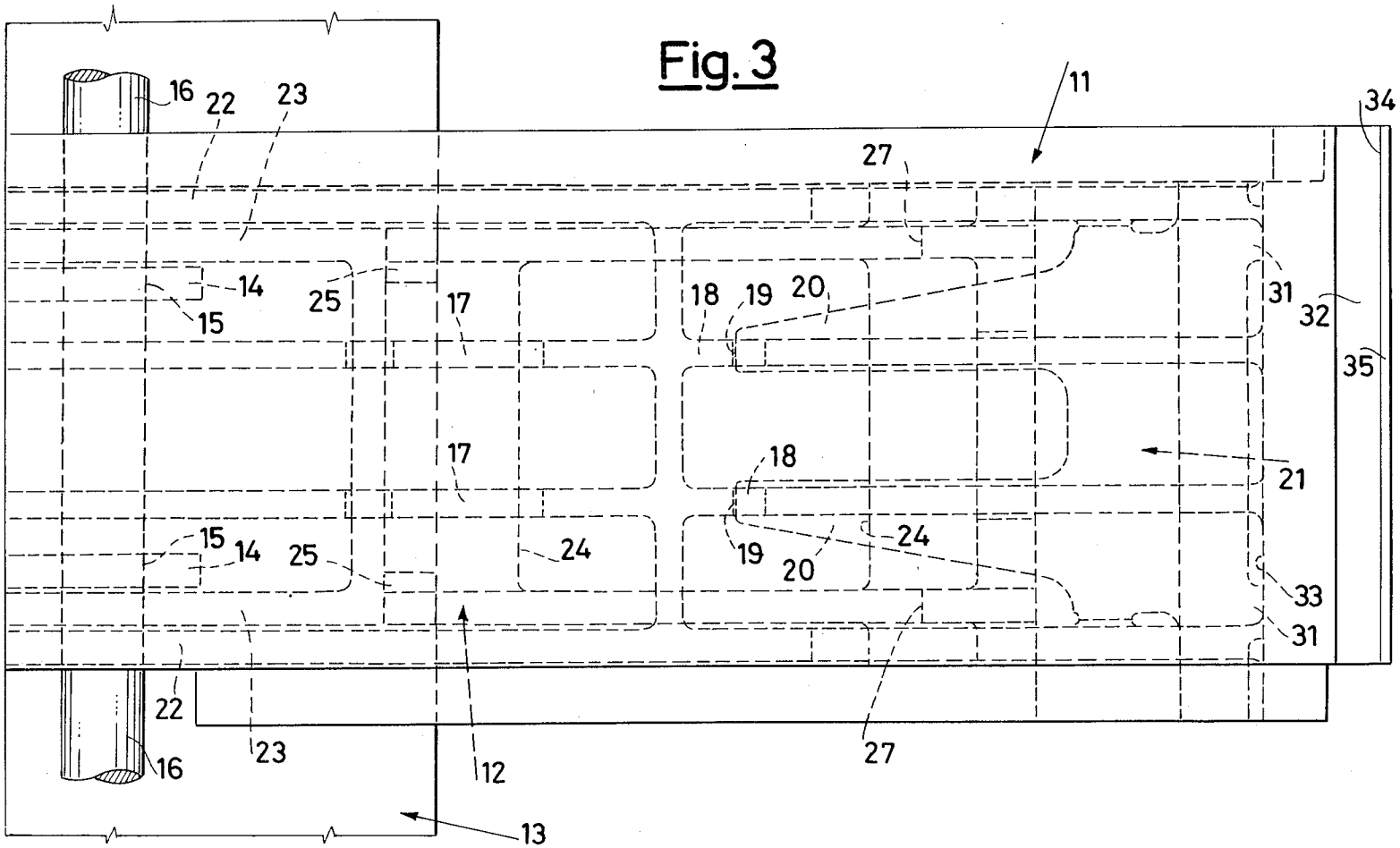
FIG. 3 is a top plan view of the grid element shown in FIG. 1.
Figure 4:
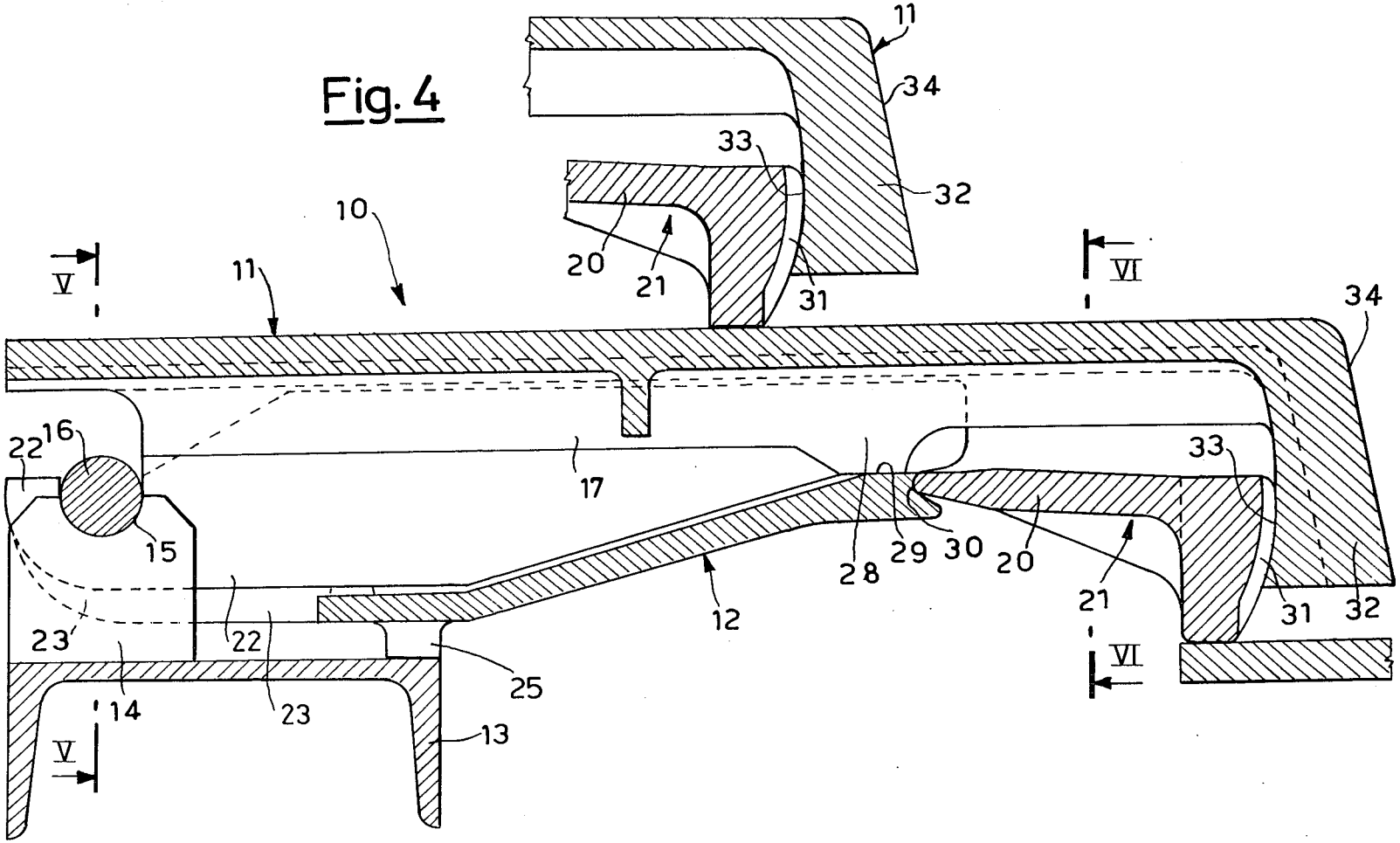
FIG. 4 is a sectional view of a further example of a grid element according to the present invention, according to path IV—IV of FIG. 5.

Referring to the drawings, a grid element according to the present invention is generally indicated at 10, and essentially comprises an upper cover plate 11 and a lower support box 12, coupled with each other above a beam 13 of the frame of furnace steps (not shown).

A set of plates 14, protruding upwards and welded to beam 13, are provided in their upper portion with a shaped seat 15, inside which a single round bar 16 is positioned, fastened by welding, and continuous throughout the grid width.

The upper plate 11, which is exposed to fire, is provided in its lower portion with a set of ribs 17, which strengthen it and render it able to bear and to handle a considerable weight of waste in the presence of high temperatures.

Furthermore, inside said upper plate 11, in the middle thereof, a couple of curved supports 18 are provided, which bear, positioned inside concavities 19 thereof, ends of arms 20 of a "hammer", which typically has a front sweeping curved edge 21.

The upper plate 11 is rewardly coupled, by means of a rear hook-shaped portion 22 thereof, with the continuous bar 16 constrained to the beam 13 throughout the grid width.

The lower box 12 is also coupled with the continuous bar 16 by means of rear curved, hook-shaped portions 23 thereof; whilst in its lower portion, it is provided with a central opening 24 able to allow air passage. Feet 25 allow the lower box 12 to rest above the beam 13, and keep it near to the lower side of upper plate 11, which leans onto it at 36.

It is evident that a set of such grid elements put side by side to each other form a step of furnace grid.

Sideways, said upper plate 11 is provided with longitudinal protrusions 26, extending in correspondence of the bottom side and/or of the top side thereof, so that the protrusions 26 of adjacent plates are coupled with each other in a complementary fashion, so to secure a good tight fit relative to penetrations of the material being treated.

In its front portion, the lower box 12 is open at 27, so as to allow the primary combustion air, penetrating from the central opening 24 and from the lower portion of hammer 21, to circulate under the upper plate 11 and to accomplish a controlled blowing in, with air streaming outward through a hollow front area 31 in the vicinity of the sweeping edge of hammer 13.

In the further example shown in FIGS. from 4 to 6, it can be observed that in a grid element 10 modifications can be alternatively provided both on the upper plate 11 and on the lower support box 12. Thus an optimum circulation of combustion air is provided, with a greater cooling effect of said upper plate.

In fact, the upper plate 11 does not support any longer the ends of arms 20 of hammer 21, but it is only provided with an enlarged inner portion 28 facing the lower box 12.

The contact between the upper plate 11 and the lower plate 12 occurs in a central area 29 of this latter, which protrudes from the feet 25 leaning on beam 13, and does not have the central opening 24.

Said central area 29 is on the contrary provided with front concavities 30 which house the ends of arms 20 of hammer 21.

One can thus observe how the controlled blowing in of air shall take place between the feet 25 above the beam 13, air flowing then between the upper plate 11 and the lower box 12, and exiting the grid element 10 from a front, hollow portion 31 of hammer 21.

It can be furthermore understood how the assemblage and the disassemblage of the upper plate 11 and of the lower support box 12, constituting the grid element 10, may take place in a very simple and quick way, by the couple of curved, hook-shaped portions 22 and 23 being inserted beneath the continuous round bar 16. More precisely, with the curved portions 23 of the lower support box 12 being first inserted, and with the curved portions 22 of the upper plate 11 being subsequently inserted.

Naturally, in both of the exemplifying elements, the upper covering plate 11 is provided, front and side, with complete-covering edges, so that for each grid step a compact and at the same time articulated structure is achieved, which does not show any vertical clefts which may be penetrated downwardly by dust or material particles, and from which the primary combustion air, pressurized under the grid, cannot escape upwards.

Particularly important is the outlet of air from the front hollow portion 31 of the hammer in contact with the front portion 32 of the upper plate 11, because in this way only an air circulation with optimum direction and speed can be obtained.

Also usefulness results from the fact that the front portion 32 of the upper plate 11 has been provided with a large thickness, so that it shows a higher wear strength, and is endowed with higher resistance to the chemical and physical attack by the slag.

Advantageously, the front portion 32 is interiorly provided with an arched and rounded surface 33, so to make easier and to accompany the movement of the sweeping hammer 21, while it is externally provided with a sloped surface 34, so to improve the waste turning action.

Preferably, the front corner of outer surface 34 of upper plate 11 front portion is provided with a reinforced flat edge 35, as shown in FIG. 1.

I claim:

1. An element of a stepwise grid for waste incinerator furnaces of the type forming, together with similar grid elements, a step of a grid carried on a support beam, comprising:

(a) an upper plate member, (b) a lower support box member, (c) means for coupling said lower support box to said upper plate, (d) said coupling means comprising a hook portion on said upper plate member and on said support box member, (e) a continuous bar positioned between and contacting said hook portions forming an articulated joint, (f) a movable hammer having a front portion and a rear portion and a sweeping curved front edge at said front portion, (g) means for sliding said hammer on a grid element of a lower step, including means for pivotally coupling a rear arm of said hammer in a concavity of one of said members, and (h) means for circulating air through the element including a narrow passage between a front portion of said hammer and a portion of said upper plate member.

2. Grid element according to claim 1, characterized in that said upper plate member is provided with a set of lower ribs, and wherein said front portion is formed of considerable thickness and is provided with an arched inner surface coupled with a complementary surface of said hammer, and with an essentially flat outer surface.

3. Grid element according to claim 1, characterized in that said lower support box is provided with feet allowing said box to lean onto said support beam, and a lower central opening.

4. Grid element according to claim, characterized in that said coupling means is provided under said upper plate member.

5. Grid element according to claim 1, characterized in that said coupling means includes said lower box provided at a front face with a concave contact portion.

6. Grid element according to claim 1, characterized in that said hammer is provided in its front face with a hollow portion suitable to be coupled with said inner arched surface of said front face portion of said upper plate member.

* * * * *